US009013306B2

(12) United States Patent
Koh et al.

(10) Patent No.: US 9,013,306 B2
(45) Date of Patent: Apr. 21, 2015

(54) SECURITY DEVICE

(71) Applicant: Racer Technology Pte. Ltd., Singapore (SG)

(72) Inventors: Kee Joo Willy Koh, Singapore (SG); Chee Kean Lim, Singapore (SG); Kia Boon Chew, Singapore (SG)

(73) Assignee: Racer Technology Pte Ltd, Singapore (SG)

( * ) Notice: Subject to any disclaimer, the term of this patent is extended or adjusted under 35 U.S.C. 154(b) by 37 days.

(21) Appl. No.: 13/825,921

(22) PCT Filed: Oct. 5, 2012

(86) PCT No.: PCT/SG2012/000373

§ 371 (c)(1),
(2) Date: Aug. 28, 2013

(87) PCT Pub. No.: WO2014/055036

PCT Pub. Date: Apr. 10, 2014

(65) Prior Publication Data

US 2014/0096574 A1 Apr. 10, 2014

(51) Int. Cl.

| | |
|---|---|
| ***G08B 13/14*** | (2006.01) |
| ***E05B 45/00*** | (2006.01) |
| ***E05B 67/00*** | (2006.01) |
| ***E05B 39/00*** | (2006.01) |
| *G07C 9/00* | (2006.01) |

(52) U.S. Cl.

CPC ..... *E05B 45/005* (2013.01); *E05B 67/003* (2013.01); *E05B 39/005* (2013.01); *G07C 2009/0092* (2013.01); *Y10S 439/9281* (2013.01)

(58) Field of Classification Search

USPC ..... 340/568.1–568.8, 571.1–572.9; 70/14, 70/15, 57.1, 63, 158, 163, 431, 432, 439, 70/18, 30, 49, 58, 233; 361/796, 752, 600; 439/928.1

See application file for complete search history.

(56) References Cited

U.S. PATENT DOCUMENTS

| | | | | |
|---|---|---|---|---|
| 5,222,776 | A * | 6/1993 | Georgopoulos et al. | 292/323 |
| 5,408,212 | A * | 4/1995 | Meyers et al. | 340/427 |
| 5,796,337 | A | 8/1998 | Wachsman | |
| 5,856,782 | A | 1/1999 | Sasagawa et al. | |
| 5,871,243 | A * | 2/1999 | Wenk | 292/320 |
| 5,959,532 | A * | 9/1999 | Fujiuchi et al. | 340/572.3 |
| 6,131,969 | A * | 10/2000 | Natkins | 292/323 |

(Continued)

OTHER PUBLICATIONS

International Search Report for PCT/SG2012/000373 dated Nov. 22, 2012.

*Primary Examiner* — George Bugg
*Assistant Examiner* — Edny Labbees
(74) *Attorney, Agent, or Firm* — Sughrue Mion, PLLC

(57) ABSTRACT

A security device for securing an item, the security device comprising a housing configured to house a circuit board comprising electronics configured to send a telecommunication signal to a receiver when the electronics is activated; a cable configured to establish a conductive path with the circuit board when the housing is closed, thereby activating the electronics; a lock assembly configured to be activated when the housing is closed; and a cover configured to close the housing, the cover having a first pin configured to engage a first end of the cable to prevent removal of a first end of the cable from the housing when housing is closed, and the cover having a second pin configured to activate the lock assembly to prevent removal of a second end of the cable from the housing when the housing is closed.

15 Claims, 6 Drawing Sheets

(56) References Cited

U.S. PATENT DOCUMENTS

| | | | | |
|---|---|---|---|---|
| 6,243,005 | B1 * | 6/2001 | Haimovich et al. | 340/427 |
| 6,578,886 | B1 | 6/2003 | Bystry et al. | |
| 7,472,933 | B2 * | 1/2009 | Weedon et al. | 292/307 A |
| 7,474,209 | B2 * | 1/2009 | Marsilio et al. | 340/568.1 |
| 7,616,116 | B2 * | 11/2009 | Ehrensvard et al. | 340/571 |
| 7,626,501 | B2 * | 12/2009 | Feibelman | 340/568.2 |
| 7,659,817 | B2 * | 2/2010 | Conti et al. | 340/568.2 |
| 8,065,895 | B2 * | 11/2011 | Andersen | 70/14 |
| 8,666,664 | B2 * | 3/2014 | Chiu et al. | 702/1 |
| 2009/0303046 | A1 | 12/2009 | Eckert et al. | |
| 2010/0171621 | A1 | 7/2010 | Yang | |
| 2011/0115632 | A1 | 5/2011 | Yang | |

* cited by examiner

SECURITY DEVICE

CROSS REFERENCE TO RELATED APPLICATIONS

This application is a National Stage of International Application No. PCT/SG2012/000373, filed on Oct. 5, 2012, the contents of all of which are incorporated herein by reference in their entirety.

FIELD OF THE INVENTION

The invention relates to a security device for securing an item, and particularly, though not exclusively, relates to a security device for securing an item to be conveyed.

BACKGROUND

In today's global market, goods are conveyed internationally and their safe delivery is viewed with great importance by the many organizations involved. In particular, it is important to guard against theft and misdirection, or at least to provide a deterrent to unauthorized or illegal activity involving the goods. Besides the conveyance of goods, it is also often desired to secure items of value even during storage. Devices exist that are intended to serve the above functions. However, many are either prohibitively costly, or easily tampered with. There is thus a need to provide a secure and cost effective device that can be operated easily and requiring minimal reconfiguration or retrofitting of additional components to the conveyance vehicles.

SUMMARY OF THE INVENTION

According to a first exemplary aspect, there is provided a security device for securing an item, the security device comprising a housing configured to house a circuit board comprising electronics configured to send a telecommunication signal to a receiver when the electronics is activated; a cable configured to establish a conductive path with the circuit board when the housing is closed, thereby activating the electronics;

a lock assembly configured to be activated when the housing is closed; and a cover configured to close the housing, the cover having a first pin configured to engage a first end of the cable to prevent removal of a first end of the cable from the housing when housing is closed, and the cover having a second pin configured to activate the lock assembly to prevent removal of a second end of the cable from the housing when the housing is closed.

The activated lock assembly may be configured to allow passage of the cable therethrough in only a first direction such that the cable is prevented from being withdrawn from the activated lock assembly.

The cable may comprise an inner conducting core in electrical connection with the first end of the cable, a layer of insulation disposed around the inner conducting core, and a layer of conducting material disposed around the layer of insulation, the layer of conducting material being in electrical connection with the inner conducting core only at the second end of the cable.

The housing may further comprise a contact portion configured to establish an electrical connection with a conducting tip provided at the first end of the cable. The security device may further comprise a switch configured to establish an electrical connection between the contact portion and the circuit board when the switch is depressed.

The housing may further comprise a conducting block configured to establish an electrical connection between the circuit board and the layer of conducting material of the cable when the cable is passed through the conducting block.

The lock assembly may comprise a roller configured to engage the cable only when the lock assembly is activated. The roller may be configured to be moved by the cable to allow passage of the cable through the lock assembly in the first direction, and to be locked by movement of the cable in a direction opposite to the first direction to prevent the cable from being withdrawn from the activated lock assembly.

The cover may be configured to be securely closed.

The second pin may be configured to activate the lock assembly by activating a positioning mechanism configured to position the roller to engage the cable. The positioning mechanism may comprise a lever having a first lever end configured to be displaced by the second pin when the cover is closed and a second lever end in connection with the roller such that displacement of the first lever end results in displacement of the second lever end to move the roller into position to engage the cable. The first end of the lever may be configured to be displaced by the second pin via a rod provided between the second pin and the first end of the lever, the rod being configured to be slideably displaced by the second pin when the cover is closed and to thereby displace the first end of the lever.

The electronics may be configured to send the telecommunication signal via at least one of: GPS, GPRS, SATCOM and RFID.

The electronics may be configured to have dual-SIM capabilities.

The electronics may be configured to send a notification to the receiver when the conductive path is broken as a result of at least one of: the cable being cut and the housing being opened.

BRIEF DESCRIPTION OF THE DRAWINGS

In order that the invention may be fully understood and readily put into practical effect there shall now be described by way of non-limitative example only exemplary embodiments of the present invention, the description being with reference to the accompanying illustrative drawings.

In the drawings.

DETAILED DESCRIPTION OF THE EXEMPLARY EMBODIMENTS

An exemplary embodiment of the security device 10 will be described with reference to FIGS. 1 to 6 below.

Figure 1:
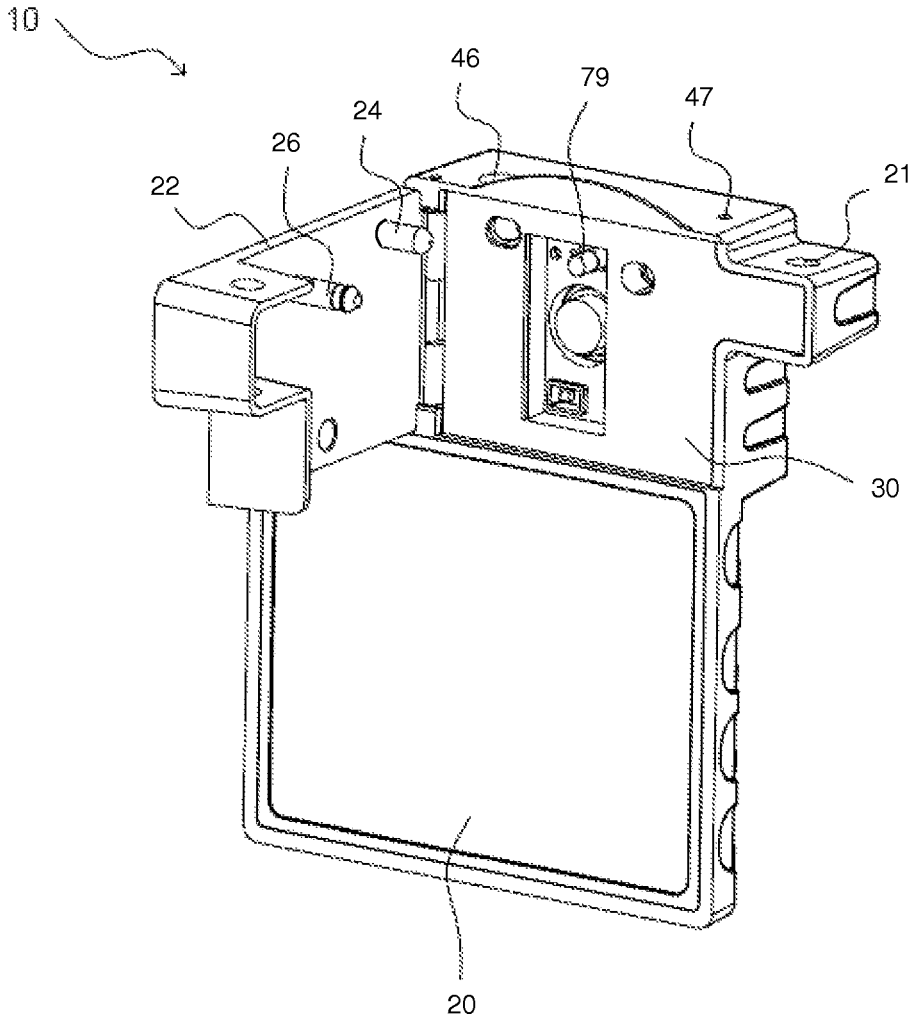
FIG. 1 is a schematic perspective view of a security device with a cover open.

As shown in FIG. 1, the security device 10 comprises a housing 20 containing electronics (not shown) configured to send a signal to a receiver when the electronics is activated by attaching the security device 10 to an item to be secured. The item may be anything that needs to be continually monitored, whether this is during movement of the item or during storage or display of the item. The item includes any mode of conveyance for transporting cargo to be monitored. For example, the security device 10 is particularly suited for securely monitoring transit goods conveyed by road, sea and rail, including both containerized and non-containerized cargo, fuel trucks, bulk liquid tankers and motor vehicle units. The security device 10 is also applicable for goods to be transported to bonded warehouses, export goods, goods in transit (for example from port to container freight station and inland container terminal), transhipment goods, goods imported or exported under various governmental programs and so on.

Preferably, the electronics is configured to record events, GPS location, direction of travel, speed and security status of the security device 10, with an ability to record and manage thousands of events. The electronics is preferably also configured to constantly monitor the environment for shock and change in light, temperature and humidity conditions, and to immediately report any detection of a security tamper with the security device 10.

Preferably, the electronics is configured to operate via Global Positioning System (GPS), a free, space-based satellite navigation system that provides location and time information anywhere where there is an unobstructed line of sight to four or more GPS satellites. In this configuration, the electronics uses GPS time and comprises and integrated onboard GPS patch antenna. Jammer detection and reduction is preferably provided, together with multi-path detection and compensation. The electronics is also preferably configured to have high sensitivity, and preferably supports well known GPS improvement systems such as Differential GPS (DGPS), Wide Area Augmentation System (WAAS), European Geostationary Navigation Overlay Service (EGNOS), Multifunctional Satellite Augmentation System (MSAS) and/or GPS-aided geo-augmented navigation (GAGAN).

Alternatively or additionally, the electronics is configured to operate via General Packet Radio Service (GPRS), a packet-oriented mobile data service on a 2G or 3G cellular communication system's global system for mobile communications (GSM). In this configuration, the electronics preferably supports worldwide operation using Quad Band GSM at 850/900/1800/1900 MHz frequency and dual-SIM operation, where SIM refers to Subscriber Identification Module (SIM), an integrated circuit that securely stores an International Mobile Subscriber Identity (IMSI) and related keys used to identify and authenticate subscribers on mobile devices. By providing dual-SIM capabilities, users can use two SIM to enjoy a wider GPRS coverage. The dual-SIM can also be based on origin and destination countries to enjoy lower local GPRS data rates for cross-border tracking. Preferably, the electronics is compliant with GSM Phase 2/2+ and supports TCP/IP.

Alternatively or additionally, the electronics is configured to operate via satellite communications (SATCOM), supporting worldwide operation with satellite coverage using a worldwide approved frequency band for satellite communication. This allows use of a small antenna to reduce overall form factor of the security device 10, and allows short data transmission bursts to reduce cost and power consumption. Preferably, TCP/IP is supported with short latency in data transfer to ensure timely delivery. By providing SATCOM capabilities, data delivery is assured even when GPRS communication is not available.

Alternatively or additionally, the electronics is configured to operate via Radio-frequency identification (RFID), a wireless non-contact system that uses radio-frequency electromagnetic fields to transfer data. The electronics is configured to have worldwide approved 2.4 GHz ISM band operation, having a common antenna interface for data transmission and receiving. Gaussian Frequency-Shift Keying (GFSK) Modulation may be provided to reduce interference. The electronics is configured to communicate with wireless sensors. Preferably, the electronics are configured to meet approved standards for shock and vibration. A protection type used for the security device 10 preferably meets IEC 60529 requirements for IP-65 intrusion protection from dust and/or water.

Preferably, the electronics operate with a non-replaceable, rechargeable battery. Preferably, the electronics is configured to report and display a low-battery status. Thus, no external battery source, or antenna, is required.

The electronics described above is thus configured to provide continuous monitoring and detection of security tamper as well as continuous environment monitoring. GPS acquisition is preferably constantly performed and wireless reports can be sent over a GPRS cellular infrastructure. By providing a failover to SATCOM, delivery of wireless reports can thus be guaranteed.

As shown in FIG. 1, the housing 20 comprises a lock assembly 30 provided in the housing 20. The lock assembly 30 is configured to be in electrical connection with the electronics. The security device 10 also comprises a cable 40 having a first end 42 configured to be in electrical connection with the electronics, and a second end 44 configured to be passed around a locking provision of the item, for example, the locking bars of a container.

Figure 2:
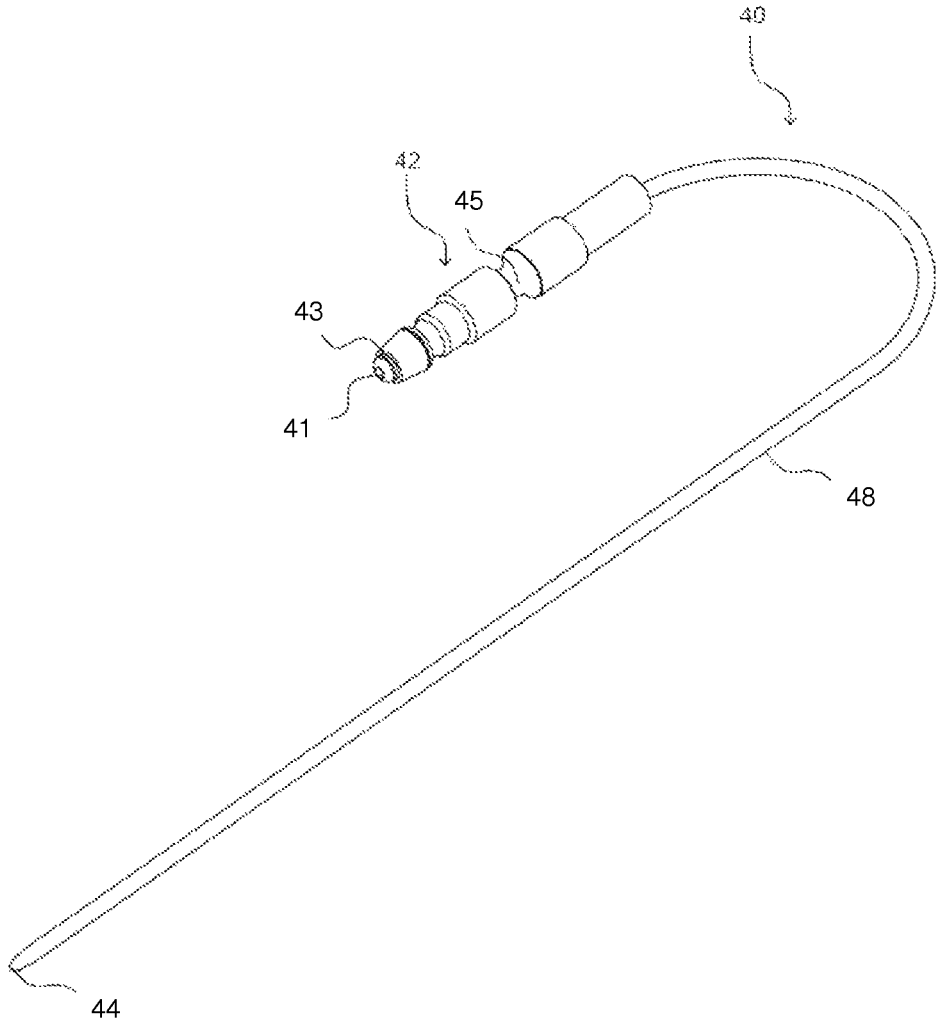
FIG. 2 is a schematic perspective view of a cable of the security device of FIG. 1.

The cable 40 as shown in FIG. 2 preferably comprises an inner conducting core (not shown) in electrical connection with the first end 42 of the cable 40, a layer of insulation (not shown) disposed around the inner conducting core, and a layer of conducting material 48 disposed around the layer of insulation along the length of the cable 40. The inner conducting core and the layer of insulation may be provided together as a shielded conducting cable. The layer of conducting material 48 is preferably of stainless steel and may be provided as a stainless steel cable, but may be any other suitable material able to effect electrical connection and withstand wetting without significant corrosion. The layer of conducting material 48 is configured to be in electrical connection with the inner conducting core only at the second end 44 of the cable 40. This may be achieved by welding the inner conducting core to the layer of conducting material 48 at the second end 44.

Figure 6:
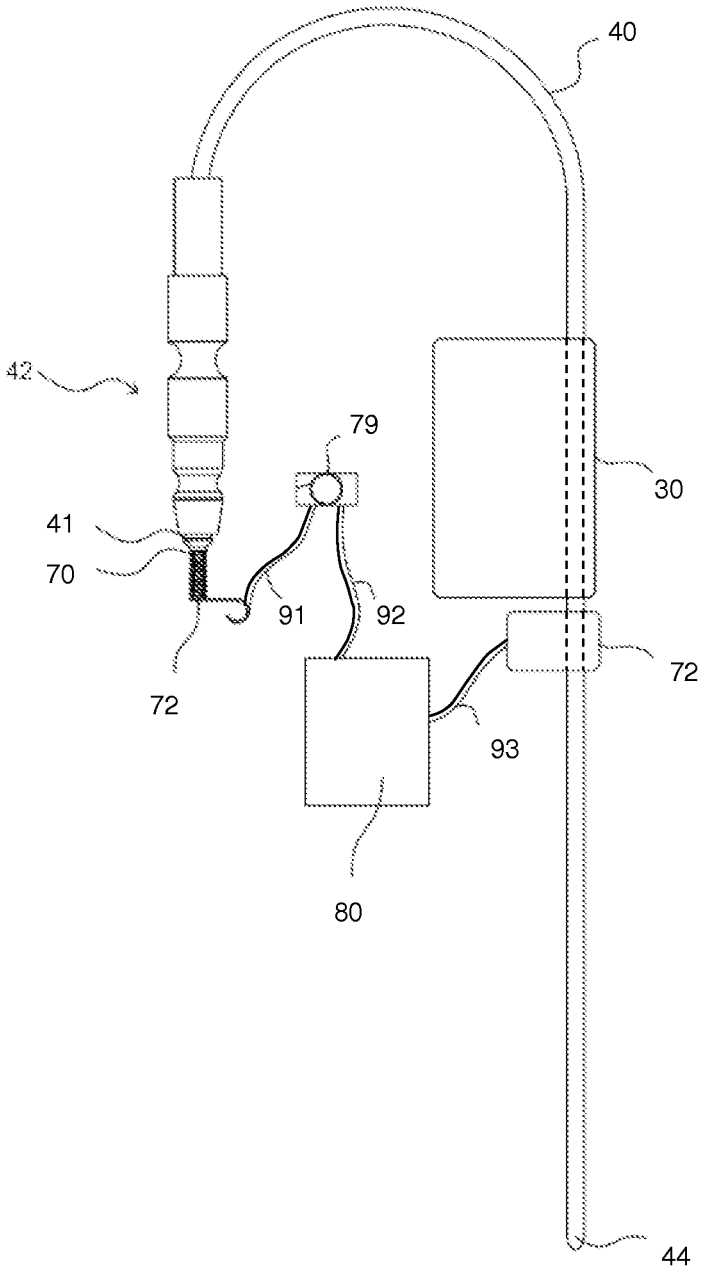
FIG. 6 is a schematic diagram of electrical connection of the cable of FIG. 2 with a circuit board.

The first end 42 is provided with a conducting tip 41 that is in electrical connection with the inner conducting core but not the layer of conducting material 48. The conducting tip 41 is preferably provided as a stainless steel ball which may be adhered to the first end 42 using epoxy 43 that prevents electrical connection with the layer of conducting material 48. As shown in FIG. 6 (where the housing 20 has been omitted for clarity), the conducting tip 41 is configured to contact a contact portion 70 provided in the housing 20 when the first end 42 has been inserted into the housing 20, thereby establishing an electrical connection between the conducting tip 41 and the contact portion 70. A contact spring 72 may be provided directly beneath the contact portion 70 to ensure good contact between the contact portion 70 and the conducting tip 41. A switch 79 is provided on the housing 20 such that an electrical connection between the contact portion 70 and a circuit board 80 comprising the electronics is established only when the housing 20 is closed. This may be achieved by means of a first conducting cable 91 provided between the contact portion 70 and the switch 79, and a second conducting cable 92 provided between the switch 79 and the circuit board 80. A recess 45, such as a groove or a notch, is preferably provided at or adjacent the first end 42 for securing the first end 42 to the housing 20 when the housing 20 is closed. In a preferred embodiment, the first end 42 is inserted into the housing 20 at a first insertion point 46 provided on the housing 20.

Figure 3:
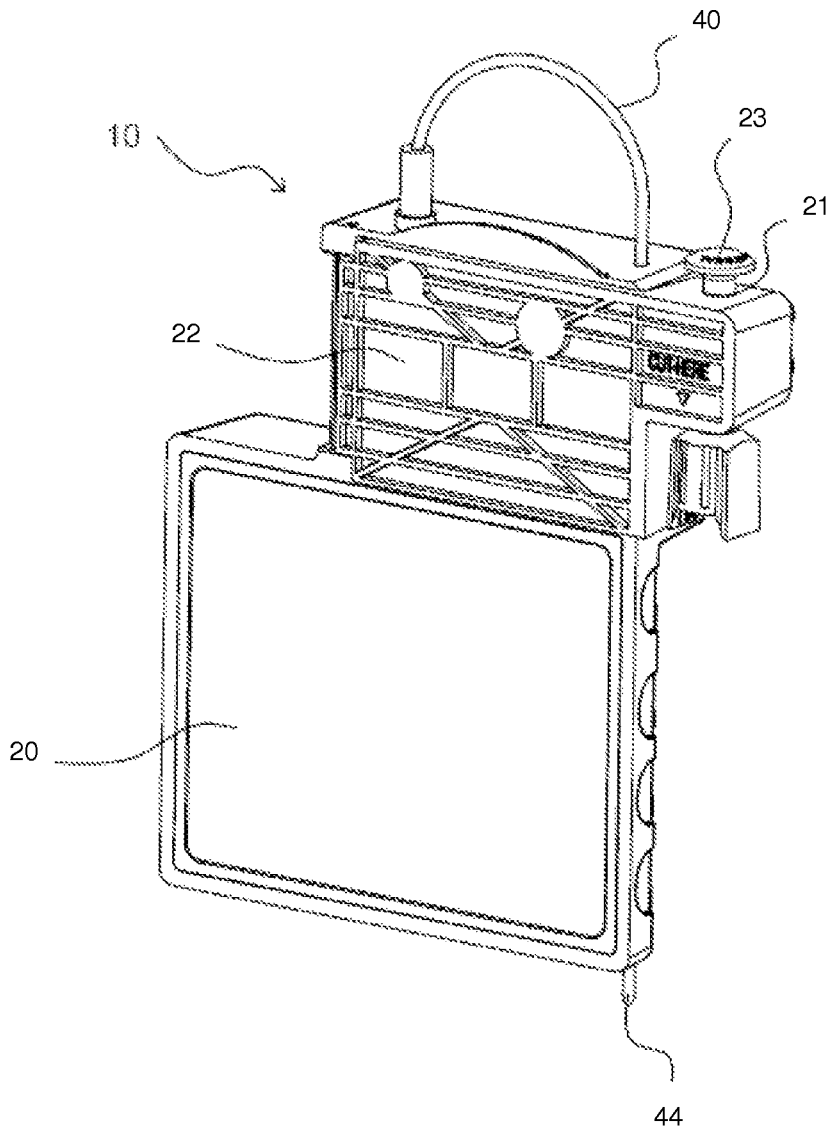
FIG. 3 is a schematic perspective view of the security device with the cover closed.

Accordingly, the housing 20 comprises a cover 22 configured to close the housing 20, as shown in FIG. 3. As shown in FIG. 1, the cover 22 has a first pin 24 configured to engage the recess 45 at or adjacent the first end 42 of the cable 40 when the cover 22 is closed, thereby preventing removal of the first end 42 of the cable 40 from the housing 20. The cover 22 is also configured to depress the switch 79 when it is closed, thereby establishing the electrical connection between the contact portion 79 and the circuit board 80. Preferably, the cover 22 is configured to be kept securely closed. This may be achieved by using a consumable bolt 23 at a cover securing location 21 provided on the housing 20. Other known appropriate securing means may be used to securely close the cover 22 at the securing location 21.

Figure 4:
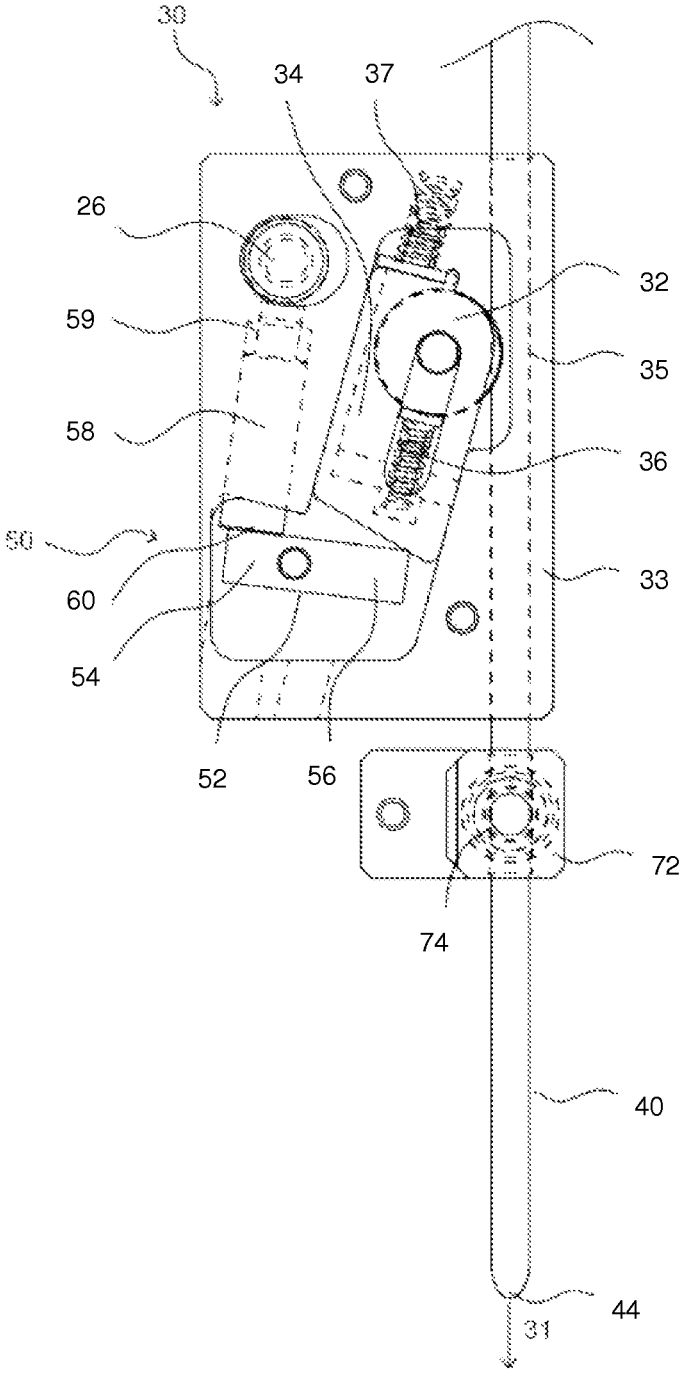
FIG. 4 is a schematic front view of a lock assembly of the security device when the cover is closed.
Figure 5:
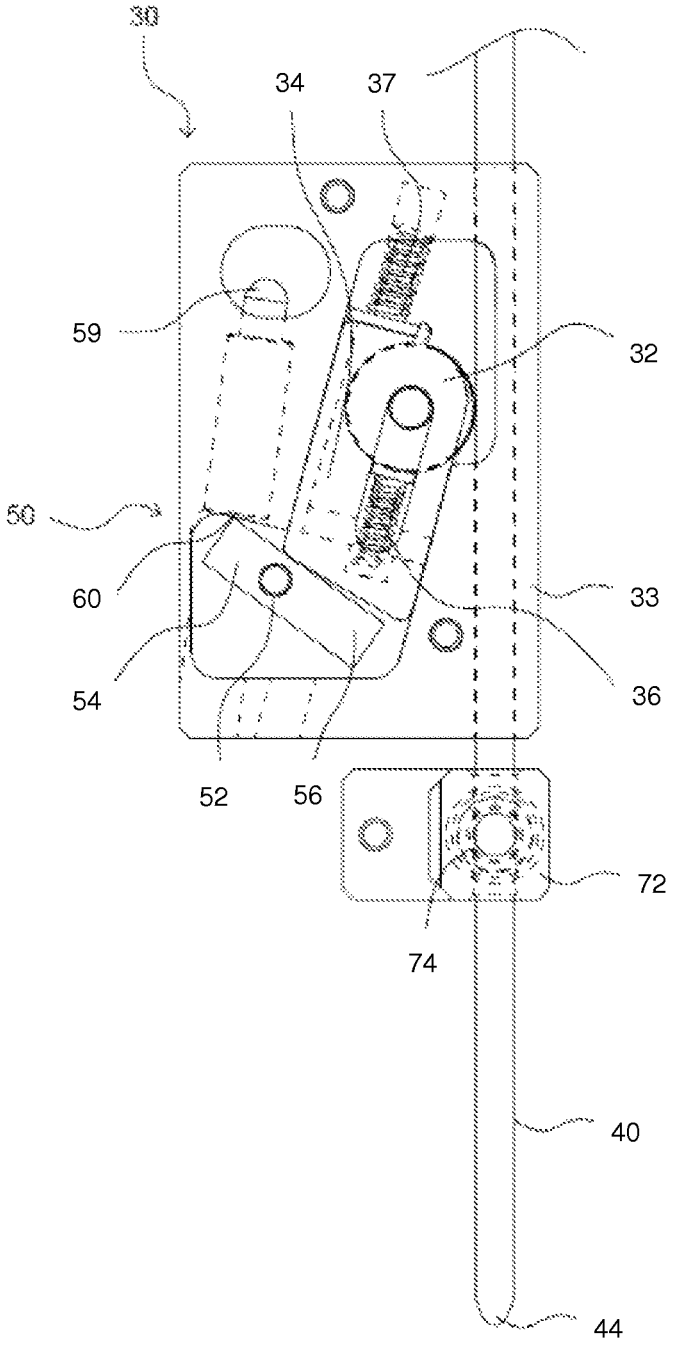
FIG. 5 is a schematic front view of the lock assembly of FIG. 4 when the cover is open.

As shown in FIG. 4, the second end 44 of the cable 40 is configured to be passed into and through a body 33 of the lock assembly 30 in a first direction (as shown by arrow 31). A second insertion point 47 is provided on the housing for passing the second end 44 through the lock assembly 30. As shown in FIGS. 4 to 6, a conducting block 72 having a conductive hole 74 therethrough is provided adjacent the lock assembly 30 where the cable 40 exits the lock assembly 30. The conductive hole 74 is configured to be in contact with the layer of conductive material 48 on the cable 40, such that an electrical connection is established between the conducting block 72 and the cable 40 when the cable 40 is passed through the conducting block 72 after passing through the lock assembly 30. The conducting block 72 is configured to be in electrical connection with the circuit board 80, for example via a third conducting cable 93.

The lock assembly 30 is configured to be activated to engage the cable 40 only when the cover 22 is closed. Accordingly, the cover 22 preferably has a second pin 26 configured to activate the lock assembly 30 when the cover 22 is closed. To that end, the lock assembly 30 preferably comprises a roller 32 configured to engage the cable 40. The roller 32 is preferably provided in the body 33 of the lock assembly 30 such that the cable 40 passes through a space between the roller 32 and a wall 35 of the lock assembly body 33. The roller 32 is configured to be positioned to engage the cable 40 only when the housing 20 is closed. Accordingly, the second pin 26 of the cover 22 activates the lock assembly 30 by activating a positioning mechanism 50 configured to position the roller 32 to engage the cable 40 when the cover 22 is closed.

The positioning mechanism 50 preferably comprises a lever 52 having a first lever end 54 configured to be displaced by the second pin 26 when the cover 22 is closed. A second lever end 56 of the lever 52 is in connection with the roller 32 such that displacement of the first lever end 54 results in displacement of the second lever end 56 in connection with the roller 32, thereby moving the roller 32 into position to engage the cable 40.

The roller 32 is preferably provided in a casing 34 configured to be in constant contact with the second lever end 56. A casing biasing element 37, such as may comprise a spring, is preferably provided to constantly bias the casing 34 against the second lever end 56 to ensure the constant contact, and to bias the casing 34 towards its un-displaced position. The casing biasing element 37 also serves to return the casing 34 and accordingly the second lever end 56 to their un-displaced positions when the cover 22 is open, thereby also returning the first lever end 54 to its un-displaced position when the cover 22 is open. The casing 34 is preferably elongate and configured to slideably engage the roller 32 along a length of the casing 34 as well as to allow rotation of the roller 32 about the roller's 32 own axis of rotation.

A roller biasing element 36 such as a spring 36 is preferably provided in the casing 34 to bias the roller 32 away from the second lever end 56. Since the roller biasing element 36 can be compressed by the roller 32 when the cable 40 pushes against the roller 32 as the cable 40 is moved in the first direction 31, movement of the cable 40 in the first direction 31 is thus always allowed because compression of the roller biasing element 36 allows the roller 32 to slide in the casing 34 towards the second lever end 56, thus making space for passage of the cable 40 through the lock assembly 30 between the roller 32 and the wall 35 of the lock assembly body 33. The roller 32 is thus configured to be moved by the cable 40 to allow passage of the cable 40 through the lock assembly 30 in a first direction, as shown by arrow 31.

Compression of the roller biasing element 36 by the roller 32 results in the roller 32 compressing the cable 40 against the wall 35 of the lock assembly body 33. Accordingly, withdrawal of the cable 40 from the lock assembly 30 by moving the cable 40 in a second direction opposite to the first direction 31 is prevented when the housing 20 is closed, since the cable 40 is effectively "gripped" between the roller 32 and the wall 35 when it is attempted to move the cable 40 in the second direction. In this way, the lock assembly 30 is configured to allow passage of the cable 40 therethrough in only the first direction 31 when the housing 20 is closed, such that the cable 40 is prevented from being withdrawn from the lock assembly 30.

Preferably, the first end 54 of the lever 52 is configured to be displaced by the second pin 26 of the cover 22 via a rod 58 provided between the second pin 26 and the first lever end 54. When the cover 22 is open, as shown in FIG. 5, a tip 59 of the rod 58 is configured to be positioned ready for contact by the second pin 26 when the cover 22 is closed, and a base 60 of the rod 58 is in contact with the first lever end 54. When the cover 22 is closed, as shown in FIG. 4, the rod 58 is slideably displaced by the second pin 26 engaging the tip 59 of the rod 58 so that the base 60 of the rod 58 displaces the first lever end 54, resulting in displacement of the second lever end 56 to position the roller 32 for engage the cable 40 as described above.

When the security device 10 is to be removed, for example when the item being secured has safely reached its destination, the cover 22 is opened, for example by cutting the consumable bolt 23 at the cover securing location 21. When the cover 22 is open, the second pin 26 ceases to engage the tip 59 of the rod 58. The rod 58 thus no longer exerts a force on the first lever end 54. Accordingly, the first lever end 54 is able to return to its un-displaced position as a result of the second lever end 56 returning to its un-displaced position, which is in turn due to the casing biasing element 37 returning the casing 34 to its un-displaced position.

When the casing 34 is returned to its un-displaced position, the roller 32 is accordingly no longer positioned to engage the cable 40 and the lock assembly 30 is no longer activated. The cable 40 is thus no longer in contact with the roller 32 and can be freely withdrawn from the deactivated lock assembly 30 and the security device 10 accordingly removed from the item.

In use, when the housing 20 is closed, the electronics is activated as a result of a conductive path formed connecting the circuit board 80, the depressed switch 79, the contact portion 70, the cable 40, the conducting block 72 and back to the circuit board 80. The electronics continually sends signals to a receiver or receivers as desired, thus allowing the security device 10 to be constantly monitored. When the cover 22 is open, the switch 79 is no longer depressed and the conductive path described above is broken. The conductive path is also broken when the cable 40 is cut, for example in the case of a tamper event. In any case, so long as the conductive path is broken, the electronics is able to detect this due to a change in the electrical connection arising either from opening the cover 22 or cutting the cable 40. Accordingly, the opening or tamper event can be recorded and transmitted to the receiver for notification.

With the security device 10 as described above, users can thus be protected from losses such as loss of revenue arising from missing, stolen or misplaced cargo, or loss of a vehicle or valuable item, as the deterrent effect of having the security device 10 is expected to reduce instances of missing or stolen cargo, or theft. Cost of administration and transportation can be reduced by replacing costly human security escorts with the cost-effective security device 10. Cargo movement can be sped up with the minimizing of manual security interventions by use of the security device 10, thereby also raising user confidence levels in the integrity of the various conveyances involved.

Whilst there has been described in the foregoing description exemplary embodiments of the present invention, it will be understood by those skilled in the technology concerned that many variations in details of design, construction and/or operation may be made without departing from the present invention. In particular, individual features in the three embodiments described above may be interchanged, separately combined or altered to form further embodiments. For example, the rod may be omitted by appropriately positioning the second pin on the cover such that the second pin directly engages and displaces the first end of the lever when the cover is closed. Other conventional securing means besides a consumable bolt may be used to keep the cover securely closed. The conducting block may be integral with the lock assembly.

The invention claimed is:

1. A security device for securing an item, the security device comprising a housing configured to house a circuit board comprising electronics configured to send a telecommunication signal to a receiver when the electronics is activated;

a cable configured to establish a conductive path with the circuit board when the housing is closed, thereby activating the electronics;

a lock assembly configured to be activated when the housing is closed; and a cover configured to close the housing, the cover having a first pin configured to engage a first end of the cable to prevent removal of a first end of the cable from the housing when housing is closed, and the cover having a second pin configured to activate the lock assembly to prevent removal of a second end of the cable from the housing when the housing is closed.

2. The security device of claim 1, wherein the activated lock assembly is configured to allow passage of the cable therethrough in only a first direction such that the cable is prevented from being withdrawn from the activated lock assembly.

3. The security device of claim 1, wherein the cable comprises an inner conducting core in electrical connection with the first end of the cable, a layer of insulation disposed around the inner conducting core, and a layer of conducting material disposed around the layer of insulation, the layer of conducting material being in electrical connection with the inner conducting core only at the second end of the cable.

4. The security device of claim 1, wherein the housing further comprises a contact portion configured to establish an electrical connection with a conducting tip provided at the first end of the cable.

5. The security device of claim 4, further comprising a switch configured to establish an electrical connection between the contact portion and the circuit board when the switch is depressed.

6. The security device of claim 1, wherein the housing further comprises a conducting block configured to establish an electrical connection between the circuit board and the layer of conducting material of the cable when the cable is passed through the conducting block.

7. The security device of claim 1, wherein the lock assembly comprises a roller configured to engage the cable only when the lock assembly is activated.

8. The security device of claim 7, wherein the roller is configured to be moved by the cable to allow passage of the cable through the lock assembly in the first direction, and to be locked by movement of the cable in a direction opposite to the first direction to prevent the cable from being withdrawn from the activated lock assembly.

9. The security device of claim 1, wherein the cover is configured to be securely closed.

10. The security device of claim 1, wherein the second pin is configured to activate the lock assembly by activating a positioning mechanism configured to position the roller to engage the cable.

11. The security device of claim 10, wherein the positioning mechanism comprises a lever having a first lever end configured to be displaced by the second pin when the cover is closed and a second lever end in connection with the roller such that displacement of the first lever end results in displacement of the second lever end to move the roller into position to engage the cable.

12. The security device of claim 11, wherein the first end of the lever is configured to be displaced by the second pin via a rod provided between the second pin and the first end of the lever, the rod being configured to be slideably displaced by the second pin when the cover is closed and to thereby displace the first end of the lever.

13. The security device of claim 1, wherein the electronics is configured to send the telecommunication signal via at least one of: GPS, GPRS, SATCOM and RFID.

14. The security device of claim 1, wherein the electronics is configured to have dual-SIM capabilities.

15. The security device of claim 1, wherein the electronics is configured to send a notification to the receiver when the conductive path is broken as a result of at least one of: the cable being cut and the housing being opened.

* * * * *